US005508729A

United States Patent [19]

Yamazaki

[11] Patent Number: 5,508,729

[45] Date of Patent: Apr. 16, 1996

[54] IMAGE FORMING APPARATUS WITH HIGH-SPEED LASER CONTROL

[75] Inventor: Hajime Yamazaki, Yokohama, Japan

[73] Assignee: Ricoh Company, Ltd., Tokyo, Japan

[21] Appl. No.: 168,226

[22] Filed: Dec. 17, 1993

[30] Foreign Application Priority Data

Dec. 19, 1992 [JP] Japan ..... 4-355923

[51] Int. Cl.[6] ..... B41J 15/16

[52] U.S. Cl. ..... 347/247

[58] Field of Search ..... 347/242, 237, 347/238, 241, 257, 256, 247; 372/26, 29, 31

[56] References Cited

U.S. PATENT DOCUMENTS 5,323,026 6/1994 Paoli ..... 372/45

5,398,008 3/1995 Nisser et al. ..... 372/26

5,432,535 7/1995 Andrews et al. ..... 347/242

FOREIGN PATENT DOCUMENTS 5-130332 5/1993 Japan .

*Primary Examiner*—Mark J. Reinhart

*Attorney, Agent, or Firm*—Oblon, Spivak, McClelland, Maier & Neustadt

[57] ABSTRACT

The present invention provides an image forming apparatus to write image data using a laser diode on a photoconductive element, wherein a high speed light output control circuit for controlling a light emitting power for each dot of a laser diode is monolithically provided on a LD driving board to maintain light output of a laser diode without placing additional load to a CPU for controlling printing operations.

6 Claims, 5 Drawing Sheets

IMAGE FORMING APPARATUS WITH HIGH- SPEED LASER CONTROL

FIELD OF THE INVENTION

The present invention relates to an image forming apparatus to write image data on a photoconductive element using a laser diode, and more particularly to an image forming apparatus such as a 1-dot multivalued printer which can express 1 dot in multiple stages.

BACKGROUND OF THE INVENTION

In a case of a laser diode, even if the driving current is kept at a constant level, light output fluctuates due to influences by changes of temperature and also an output image from an image forming apparatus becomes unstable, so that it is necessary to maintain the light output at a constant level by monitoring the light output at a specified timing. For this purpose, generally in an image forming apparatus to write image data on a photoconductive element using a laser diode, feedback control is executed by detecting light output from the laser diode.

FIG. 6 is a schematic diagram of an LD-driving board in a conventional type of image forming apparatus of a laser beam generating circuit in which, and as shown in this figure, on an LD-driving board 601 there are provided a semiconductor laser diode unit 602 in which a laser diode and a photo diode to detect strength of a laser beam generated by the laser diode have been integrated into a unit, an amplifier 603 to amplify an output from the photodiode, a driving current switching circuit 604 to drive the semiconductor laser diode unit 602, and a variable constant current supply unit 605 to supply a driving current for driving the semiconductor laser diode unit 602. In an image forming apparatus using a LD driving board having the configuration as described above, feedback control is executed via a D/A convertor 610 and the variable constant current supply unit 605 by monitoring light output from a laser diode with the amplifier 603, a D/A convertor 608, and a comparator 609 under the control by a CPU 607 on an engine board 606 for controlling printing operations.

Also to an image forming apparatus such as a printer, a demand for intermediate tone expression is high, so that a technique for using density expression making use of a plurality of adjacent dots is employed for intermediate tone expression (dither method). In the dither method, however, it is possible to provide a dummied intermediate tone, but the resolution becomes lower, so that development of a 1-dot multivalued image forming apparatus which can express 1 dot in multiple stages has been strongly desired.

With a conventional type of image forming apparatus, however, feedback control to maintain light output from a laser diode at a constant level is executed by a CPU on an engine board for controlling printing operations of the image forming apparatus, thus a large work load is put on the CPU during execution of this control, which disables printing operation control.

Also in a conventional type of image forming apparatus, to express 1 dot in multiple stages, such methods as changing the lighting time for each dot in a laser diode or changing exposure power are conceivable, but as minute and precise control over the lighting time is required for minutely changing the lighting time for each dot, the video signal generating mechanism becomes complex, which in turn results in increase of apparatus cost, and in addition a demand for noise resistance in the transmission path becomes more strict because of the necessity to transfer the signal at a higher speed. Also when changing the exposure power, the CPU must follow the speed for providing controls over the exposure power, a demand for the circuit configuration becomes more strict.

SUMMARY OF THE INVENTION

It is a first object of the present invention to make it possible to maintain light output from a laser diode at a constant level without putting any work load to a CPU for controlling printing operations.

Also it is a second object of the present invention to provide a low cost 1-dot multivalued image forming apparatus without making the demands for a video signal generating mechanism, noise resistance, and a circuit configuration more strict.

In order to achieve the first object of the present invention, the present invention provides an image forming apparatus to write image data on a photoconductive element using a laser diode in which control means for controlling a light emitting power for each dot is monolithically provided on a laser diode driving board.

Also in order to achieve the second object of the present invention, the present invention provides an image forming apparatus comprising light emitting power control means having, in addition to the configuration described above, a plurality of weighted signal lines each specifying light emitting power of a laser diode for controlling light emitting power for each dot of a laser diode based on a combination of inputs to the plurality of signal lines, in which light emitting power controlling means is monolithically provided on a laser diode driving board.

In addition to the configuration described above, it is preferable that maximum light emitting power changing means for changing the maximum light emitting power of a laser diode is monolithically provided on a laser diode driving board. Also it is preferable that the image forming apparatus includes maximum driving current detecting means for detecting a maximum driving current of a laser diode.

Also it is preferable that a land of variable resistors adjusting dispersion of individual laser diodes allows selective incorporation of both a trimmable chip resistor and a multi-stage rotary volume. Also it is preferable that a $\gamma$ conversion table corresponding to $\gamma$ characteristics of a photoconductive element is provided on a circuit board executing duty operation. Also it is preferable that maximum power setting means for setting a light emitting power of a laser diode to the maximum power when making the laser diode emit light for detecting a beam position for deciding a timing for writing is provided in the image forming apparatus.

An image forming apparatus according to the present invention maintains a light emitting power for each dot in a laser diode with control means provided on a laser diode driving board.

Also the image forming apparatus according to the present invention controls a light emitting power for each dot depending on a combination of inputs to a plurality of weighted signal lines specifying a light emitting power of a laser diode with the light emitting power control means provided on a laser diode driving board.

As described above, in an image forming apparatus to write image data on a photoconductive element using a laser diode according to the present invention, control means for controlling a light emitting power for each dot of a laser diode to a constant level is provided monolithically on a laser diode driving board, so that light output from the laser diode can be maintained at a constant level without placing work load to a CPU for controlling printing operations.

Also the image forming apparatus according to the present invention has a plurality of weighted signal lines specifying a light emitting power of a laser diode, and comprises light emitting power control means for controlling light emitting power for each dot of a laser diode based on a combination of inputs to the plurality of signal lines, said light emitting power control means monolithically provided on the laser diode driving board, so that a low cost 1-dot multivalued image forming apparatus can be provided without placing more strict demands for a video signal generating mechanism, noise resistance, and circuit configuration.

Also in addition to the configuration described above, maximum light emitting power changing means for changing the maximum light emitting power of a laser diode is monolithically provided on a laser diode driving board, so that dispersion in light output from each chip can be suppressed and the shading characteristics of the optical system can easily be corrected.

Also the image forming apparatus according to the present invention comprises maximum driving current detecting means for detecting a maximum driving current of a laser diode, so the image forming apparatus can detect shortage of power due to degradation of the laser diode and prevent images from degrading.

Also the land arrangement allows selective incorporation of both a trimmable chip resistor and a multistage rotary volume to realize a variable resistor for adjusting dispersion of individual laser diodes, so that this configuration is applicable to an apparatus in which a laser beam is adjusted in each unit and also to an apparatus in which the adjustment must be carried out in the entire optical system because mirrors or other components are too many.

Also as a $\gamma$ conversion table corresponding to $\gamma$ characteristics of a photoconductive element is provided on a circuit board for duty operation, an optimal image for each image forming apparatus can be obtained.

Also the image forming apparatus according to the present invention comprises maximum power setting means for setting a light emitting power of a laser diode to the maximum power when causing the laser diode to emit light for detecting a beam position to decide a write timing is provided, so that a sync. detection signal is accurately fetched and a dot is placed at an accurate print position.

Other objects and features of this invention will become understood from the following description with reference to the accompanying drawings.

DESCRIPTION OF THE PREFERRED EMBODIMENTS

Figure 1:
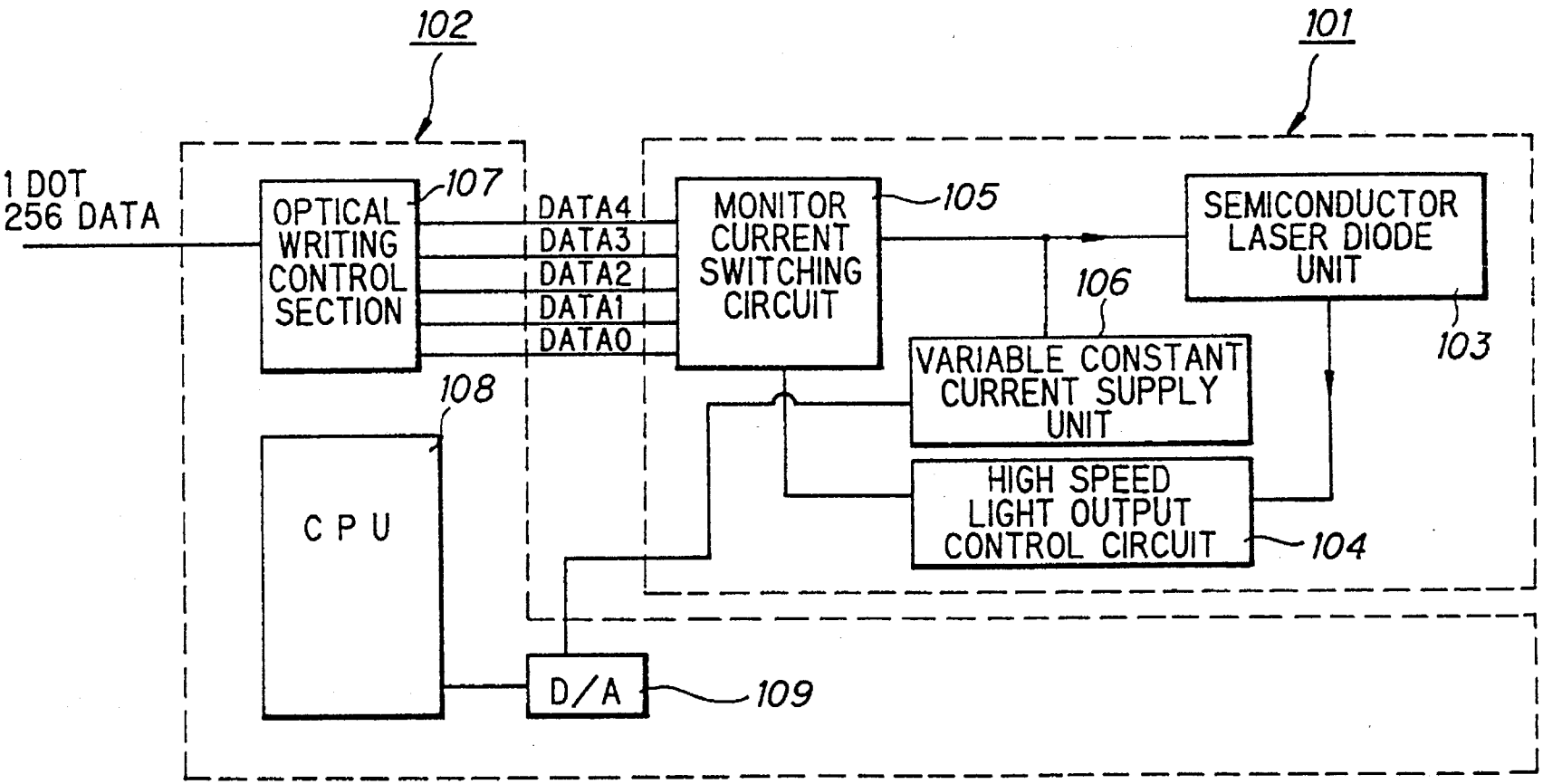
FIG. 1 is a block diagram illustrating a general configuration of an embodiment of the present invention.

Description is made hereinafter for an image forming apparatus according to the present invention with reference to related drawings. FIG. 1 is a block diagram illustrating a general configuration of an embodiment of the present invention, and as for the physical configuration the image forming apparatus comprises two boards; a LD (laser diode) driving board 101 and an engine board 102. On the LD driving board 101 are provided a semiconductor laser diode unit 103 with a laser diode for generating a laser light incorporated therein, a high speed light output control circuit 104 for controlling a light emitting power for each dot of a laser diode to a constant level, a monitor current switching circuit 105 having a plurality of weighted signal lines specifying a light emitting power of a laser diode and controlling a light emitting power for each dot of a laser diode depending on a combination of inputs to the plurality of signal lines, and a variable constant current supply unit 106. Also on the engine board 102 are provided an optical writing control section 107, a CPU 108, and a D/A convertor 109.

Figure 2:
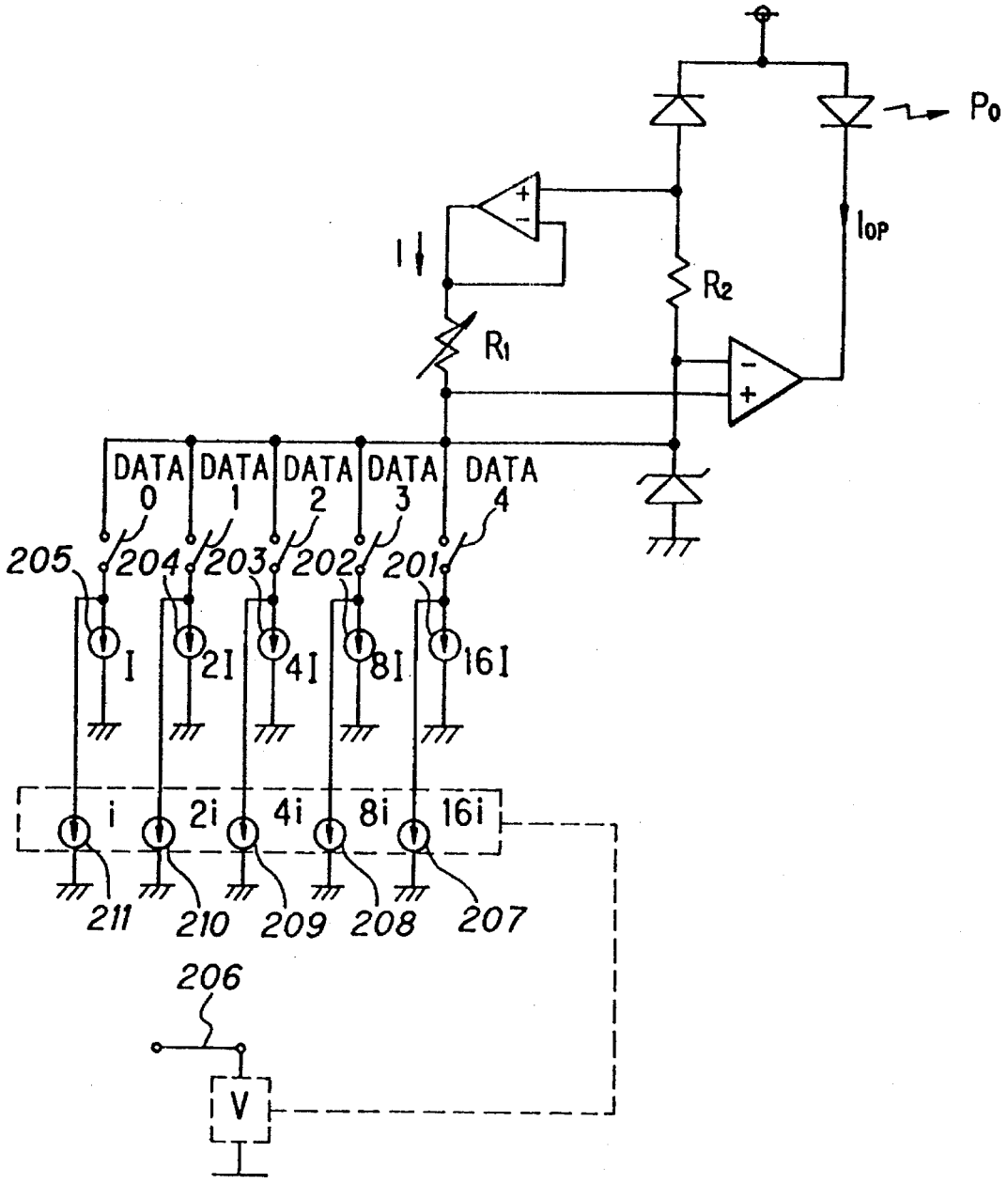
FIG. 2 is a view illustrating a detailed circuit diagram on an LD driving board.

Next description is made for operations of an image forming apparatus having the configuration as described above with reference to FIG. 2 to FIG. 5. FIG. 2 is a detailed circuit diagram on the LD driving board 101, and DATA 4 to 0 sent from the engine board 102 is supplied as an input to a monitor current switching circuit 105, wherein the input is converted to switching signals for current sources 201 to 205 so that the ratio of current values becomes 16:8:4:2:1, and a total of the currents selected according to the signals is forcefully flown as a monitor current $I_M$ to a photodiode PD incorporated in the semiconductor laser diode unit 103. The photo diode PD and the laser diode LD are connected in a form of a high speed negative feedback loop with the light output control circuit 104, and in this configuration a power (light output) $P_0$ corresponding to the monitor current $I_M$ can be obtained instantly.

Figure 3:
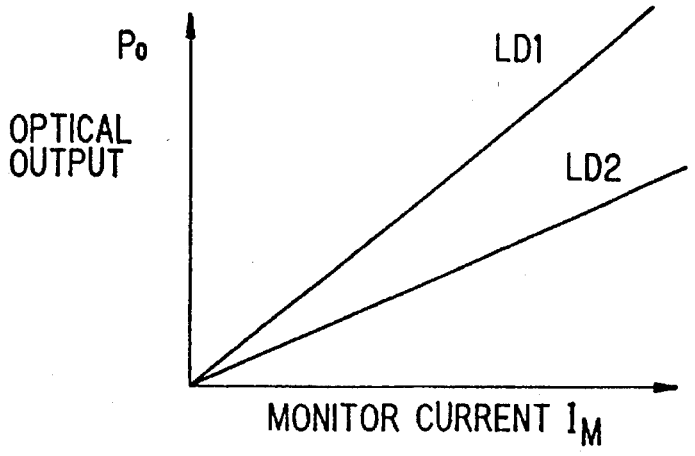
FIG. 3 is a view illustrating a relation between a monitor current IM and a corresponding light output PO.

FIG. 3 shows a relation between the monitor current and the corresponding light output $P_0$. As shown in this figure, the monitor current $I_M$ has a relation of direct proportion to the light output $P_0$, so a power corresponding to any of stages 0 to 32 can be obtained according to an instruction for strength of light emission from the outside.

As described above, the monitor current switching circuit 105 has a plurality of lines weighted according to a degree of light emitting power (5 lines for input of DATA 4 to 0), so it is possible to easily obtain a desired power by specifying a monitor current $I_M$ by means of selecting one of the lines. Also by adjusting a duty of a signal to be sent to each of the lines, it is possible to control a size and position of a dot within one dot more minutely.

Also in the proportional relation between the monitor current $I_M$ and the light output $P_0$, the slope varies according to a difference between individual laser diodes (a difference between individual solid bodies), as shown, for instance, by LD1 and LD2 in FIG. 3, but the slope can be changed by adjusting a value of $R_1$ for the variable current power supply unit 106, and a constant power can be obtained even if a laser diode to be used is changed with another one.

Furthermore, a LEVEL port 206 is provided between the LD driving board 101 and the engine board 102, and it is possible to adjust current sources 207 to 211 so that a ratio of current values is 16:8:4:2:1, and with this feature it is possible to execute minute adjustment of the monitor current $I_M$. In other words, it is possible to control the maximum output light emitting power of a laser diode LD via the LEVEL port 206. Concretely, a current $I_{OP}$ passing through the laser diode LD is monitored by a maximum driving current detecting circuit (not shown) comprising a resistor, an amplifier, and a comparator, a result of detection is sent to the CPU 108 in on the engine board 102, and the current sources 207 to 211 are adjusted via the LEVEL port 206 from the CPU 108, thus the monitor current $I_M$ being adjusted. Accordingly it is possible to prevent degradation of images previously by detecting power shortage due to degradation of a laser diode. Herein, the relation between the monitor current $I_M$ and the current sources 201 to 205 as well as current sources 207 to 211 is as shown below.

$$I=(I)+(2I)+(4I)+(8I)+(16I)+(i)+(2i)+(4i)+(8i)+(16i)$$

$$I_M=(R1/R2)\times I$$

Figure 4A:
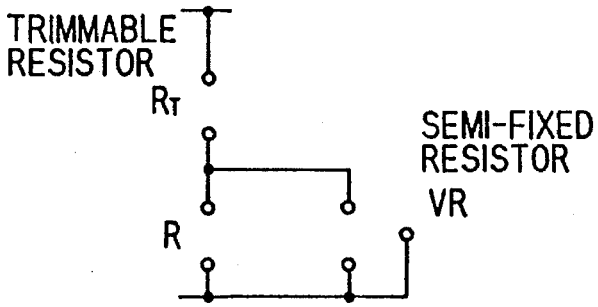
FIGS. 4A–4D are views illustrating a land arrangement for resistor ($R_1$) and a combination of resistors.
Figure 4B:
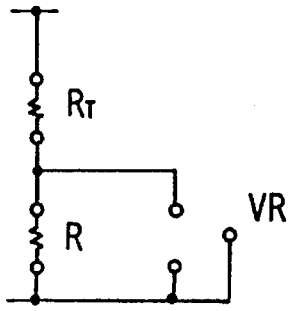
Figure 4C:
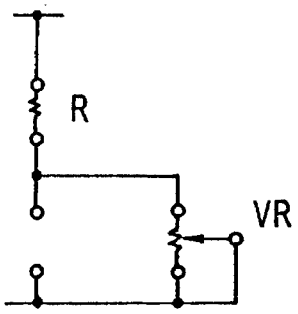
Figure 4D:
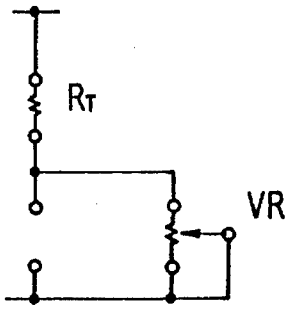

FIG. 4A shows a land arrangement of resistor ($R_1$) for the variable constant current power supply unit 106 ($R_1$) provided to suppress dispersion in characteristics of individual laser diodes. Generally in an image forming apparatus, a laser beam injected from a light source (namely, a laser diode) passes through a plurality of lenses or mirrors, so sometimes the laser beam can be adjusted in a light source unit itself, or sometimes the laser beam must be adjusted at an exit of the optical system unit, namely on a photoconductive element. For this reason, if it is possible to adjust the laser beam with a light source unit itself by employing the land arrangement as shown in FIG. 4A, a cheap trimmable chip resistor as shown in FIG. 4B is used, and if it is required to adjust the laser beam in the entire optical system unit, a semi-fixed volume (a multistage rotary volume) as shown in FIG. 4C may be used. Also as shown in FIG. 4D, a precision in adjustment can be raised by combining a trimmable chip resistor with a semi-fixed volume, using the former for rough control of injected power after the power source unit has been assembled, and carrying out fine adjustment of the latter to narrow the adjustable range of the semi-fixed volume.

Next description is made for the engine board 102. The engine board 102 has the optical writing control section 107 to receive, for instance, data of 256 bits for 1 dot and send 5-bit DATA 4 to 0 each corresponding to a cross-section of the LD driving board 101. The optical writing section 107 can provide 256 gradations for 1 dot by combining 8 stages of pulse width and 32 stages of power output. Concretely, if data of 200 is supplied as on input for one dot to the optical writing control section 107, the optical writing section 107 transforms $200=8\times2^4+7\times2^3+4\times2^2+0\times2^1+0\times2^0$, executes pulse width modulation to assign an 8/8 dot cycle pulse to DATA 4, a 7/8 dot cycle pulse to DATA 3, a 4/8 dot cycle to DATA 2 and 0/8 dot cycle (namely, OFF) to DATA 1 and DATA 0, and sends the pulse signals to the LD driving board 101. For this reason, energy of 200/256 can be written for 1 dot as a total under a combination with the LD driving board 101.

Figure 5:
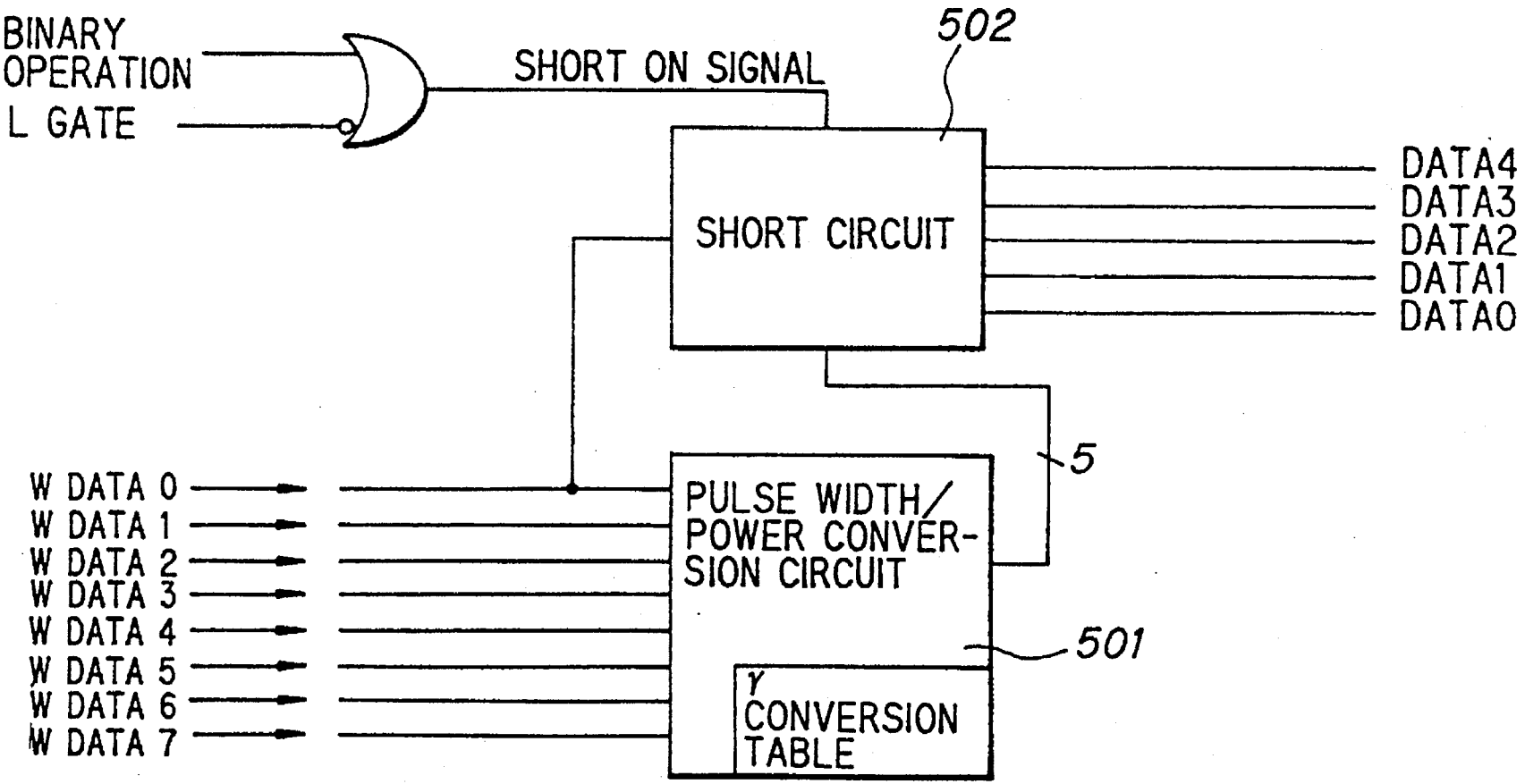
FIG. 5 is a view illustrating a configuration of an optical writing control section.
Figure 6:
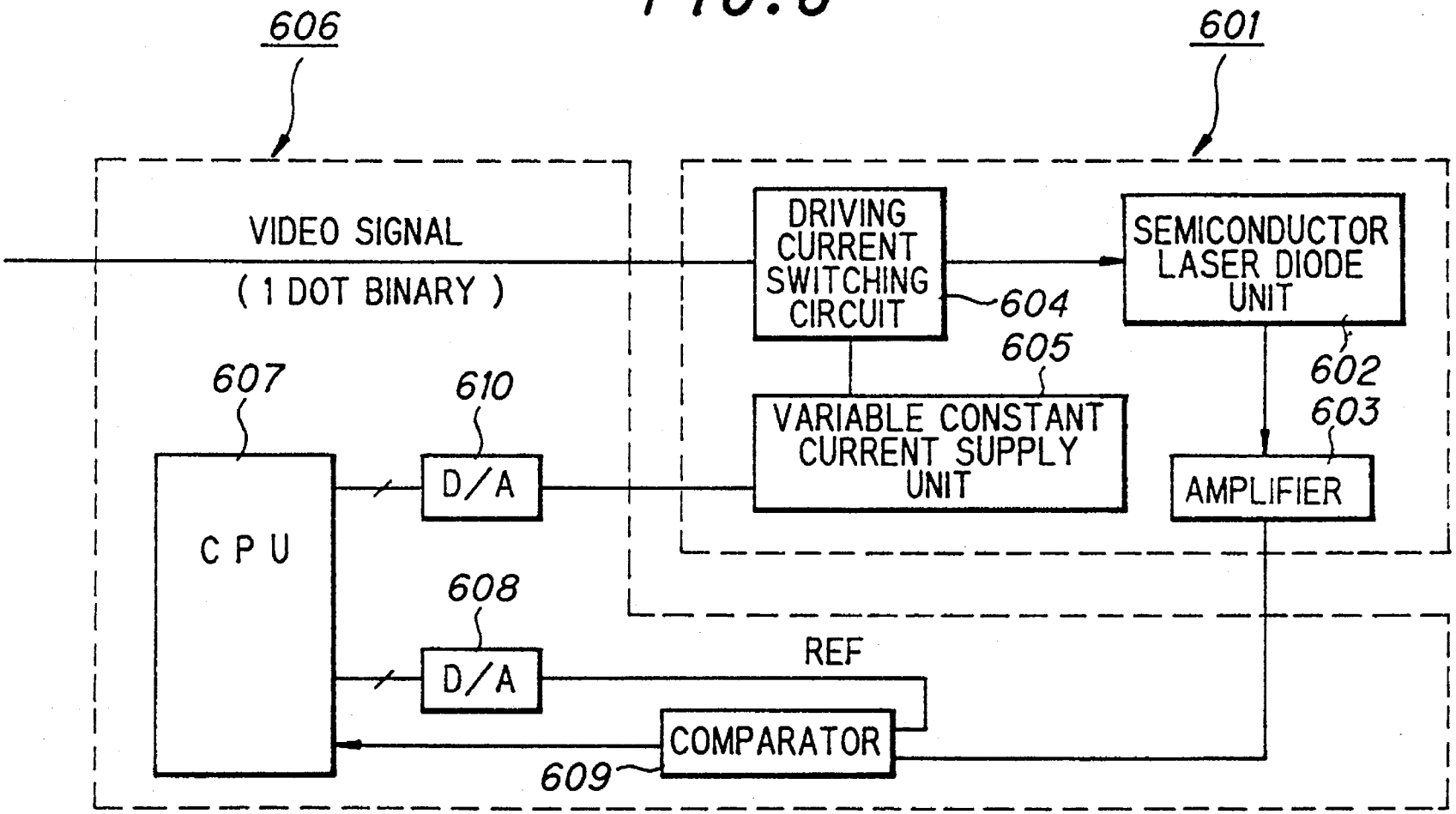
FIG. 6 is a block diagram illustrating an LD driving board in a conventional type of image forming apparatus.

FIG. 5 shows a configuration of the optical writing control section 107, which has a pulse width/power conversion circuit 501 for executing the pulse width/power conversion described above and a short circuit 502. The pulse width/power conversion circuit 501 has a γ conversion table for executing data conversion according to the γ characteristics of a photoconductive element simultaneously with the pulse width conversion as described above. Also basically the optical writing control section 107 operates as a 1-dot multitone image forming apparatus, but sometimes binary logic is enough for such operations as drawing a character, so the short circuit 502 is provided as a binary logic/multivalued logic switching mechanism so that light emission can be executed according to either one of two values, ON or OFF. Herein of 8 types of data (WDATA 0 to WDATA 7) supplied as input to the pulse width/power conversion circuit 501, WDATA 0 is shared as data (WDATA) in the binary mode.

On the other hand, in the image forming apparatus, a photodiode for synchronism detection is provided outside the photoconductive element to align a header of each line, a laser diode is forcefully caused to emit light at the position of the photodiode above, and the light is used as a synchronism detection signal. However, in an image forming apparatus executing multitone expression by modulating a power in 1 dot, power modulation is executed also outside the photoconductive element in some circuit configurations, which reduces a light emitting power of the laser diode LD and sometimes a light enough to be detected by the photodiode described above may not be obtained. To solve this problem, in this embodiment, the laser diode LD is forcefully caused to emit light with the maximum power at the position of the photodiode described above. Concretely, in FIG. 5, DATA 4-0 is shortcircuited in synchronism to LGATE (line sync. signal) in the short circuit 502 so that the light is emitted with the maximum power. With this configuration, a sync.signal can be generated under instable conditions.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus for writing image data on a photoconductive element comprising:

a laser diode driving board;

at least one laser diode generating light for emitting dots formed on the laser diode driving board;

a monitor current switch circuit connected to the at least one laser diode and for receiving a plurality of weighted signal lines which specify a light emitting power of said at least one laser diode and for controlling a light emitting power of the at least one laser diode for each emitted dot based on a combination of inputs to the plurality of weighted signal lines, the monitor current switch circuit being formed on the laser diode driving board.

2. An image forming apparatus according to claim 1, further comprising a level port connected to the at least one laser diode for changing a maximum light emitting power of the at least one laser diode.

3. An image forming apparatus according to claim 1, further comprising a maximum driving current detecting means connected to the at least one laser diode for detecting a maximum driving current of the at least one laser diode.

4. An image forming apparatus according to claim 1, further comprising a land variable resistor for adjusting dispersion of the at least one laser diode and including both a trimmable chip resistor and a multistage rotary volume.

5. An image forming apparatus according to claim 4, further comprising a γ conversion table corresponding to γ characteristics of the photoconductive element for controlling a duty operation of signals input to the plurality of weighted signal lines.

6. An image forming apparatus according to claim 5, further comprising a maximum power setting means connected to the at least one laser diode for setting a light emitting power of the at least one laser diode to a maximum power when causing the at least one laser diode and for detecting a beam position to determine a timing for the at least one laser diode emitting the dots.

* * * * *